United States Patent [19]

Zoellner

[11] Patent Number: 4,482,185

[45] Date of Patent: Nov. 13, 1984

[54] CONVERTIBLE EASEL

[76] Inventor: Philip Zoellner, 10429 Campana Dr., Sun City, Ariz. 85351

[21] Appl. No.: 462,536

[22] Filed: Jan. 31, 1983

[51] Int. Cl.[3] ..... A47B 97/04

[52] U.S. Cl. ..... 297/135; 297/156; 248/455

[58] Field of Search ..... 297/156, 135; 248/455, 248/463, 452, 464

[56] References Cited

U.S. PATENT DOCUMENTS

| | | | |
|---|---|---|---|
| 88,256 | 3/1869 | Bacon | 297/156 |
| 261,000 | 7/1882 | Lamb | 248/455 |
| 283,175 | 8/1883 | Werner | 297/156 |
| 3,023,046 | 2/1962 | Girling | 297/156 |
| 3,095,666 | 7/1963 | Killen | 248/455 X |
| 3,799,488 | 3/1974 | Sena | 248/452 |
| 4,109,892 | 8/1978 | Hartung | 248/455 |
| 4,134,614 | 1/1979 | Fielding | 297/156 |

FOREIGN PATENT DOCUMENTS

| | | | |
|---|---|---|---|
| 1582778 | 9/1969 | France | 297/135 |

*Primary Examiner*—Francis K. Zugel

[57] ABSTRACT

A painting is maintained in a clamp assembly connected to a leg of adjustable length. The leg of adjustable length and vertical bars of the clamp assembly form a tripod. The vertical bars may be connected to a pair of frame support legs at selectable locations thereon. The frame support legs and a pair of camp chair legs are respectively connected to ends of a camp chair seat. Because of the selectable locations, the seat is at a desired distance from the clamp assembly. The frame support legs are additionally connected to a tray whereon paints and brushes may be placed.

16 Claims, 15 Drawing Figures

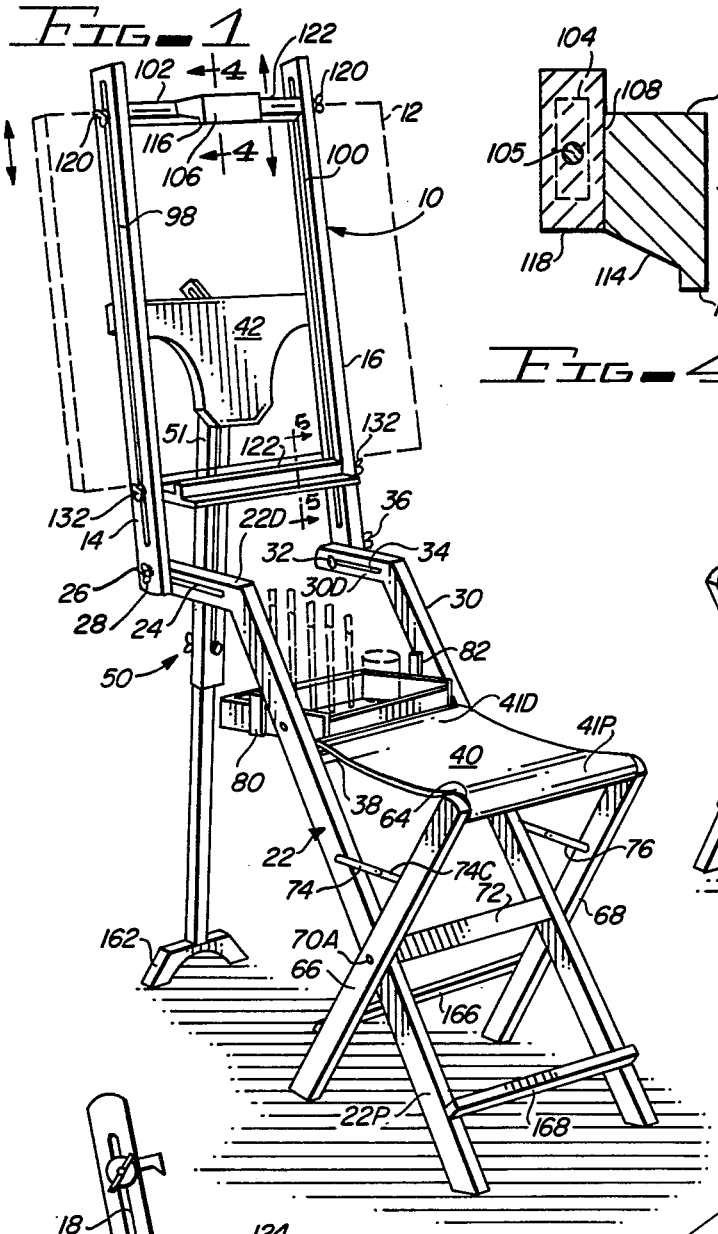
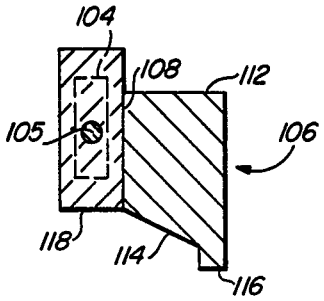
FIG. 4
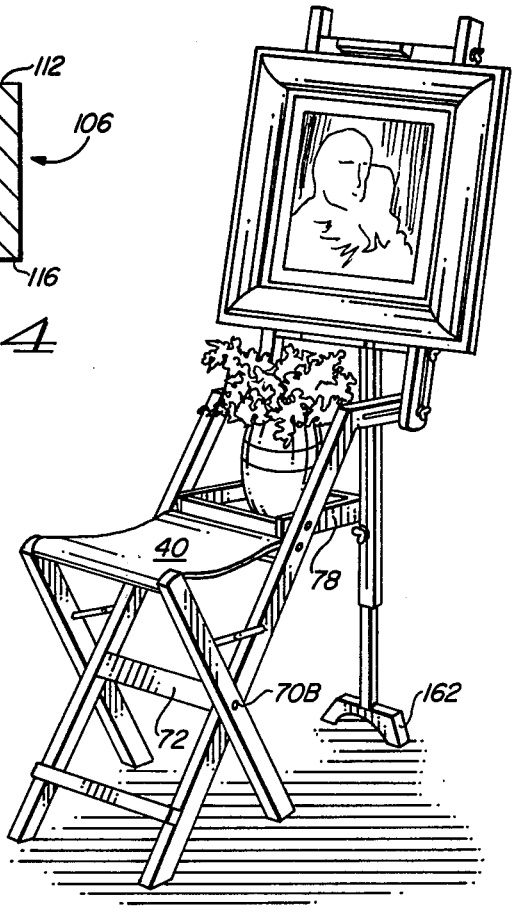
FIG. 6
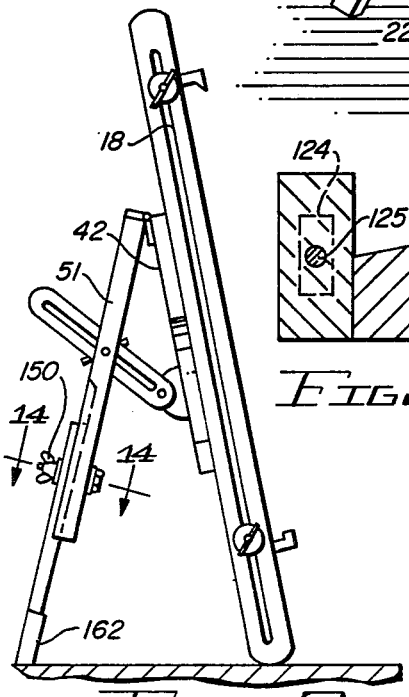
FIG. 2
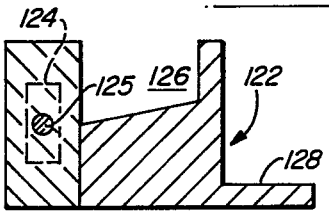
FIG. 5
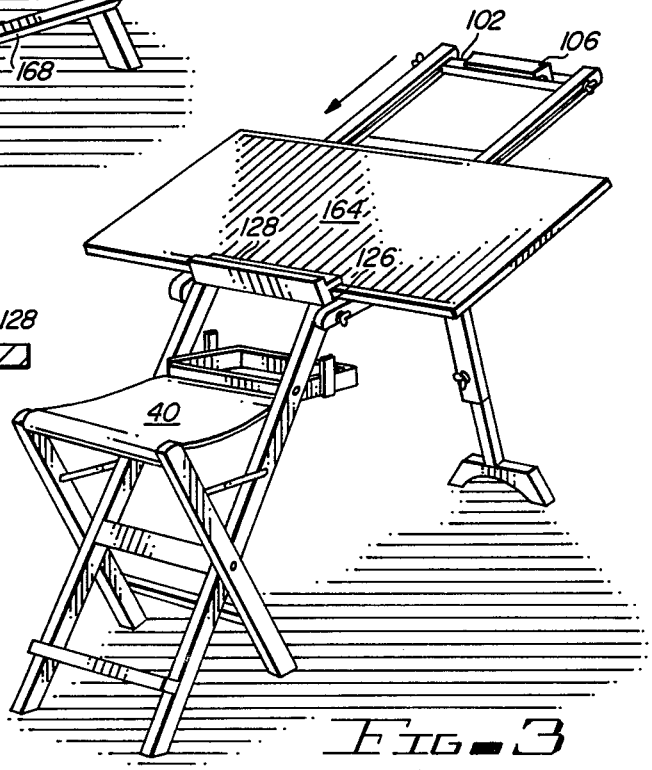
FIG. 3

CONVERTIBLE EASEL

BACKGROUND OF THE INVENTION

1. Field of the Invention

This invention relates generally to equipment for artists and more specifically to an easel.

2. Description of the Prior Art

An artist is usually unlike his traditional perception as a tireless being who paints while standing for hours at a time, pallet in hand, next to an easel. The artist often paints while seated because the easel and a camp chair have been constructed as a portable combination.

Although the artist may paint while being seated, the easel may not be moveable to a suitable position relative to the camp chair. Therefore, a canvas supported by the easel may either be uncomfortably close to the artist or inconveniently far from the artist. Additionally, the portable combination does not provide a place for the artist to keep supplies, such as paints and brushes. The supplies are preferably in easy reach of the artist.

When the portable combination is used in a classroom or in a studio, it may be desirable to place the easel on a desk or on a table. The camp chair then becomes a cumbersome inconvenience. Usually, the portable combination cannot be converted to an easel suitable for placing on a desk or on a table.

The artist often makes pictorial representations in pastel or water color. A pastel drawing is usually made upon a sketch pad. The easel is not normally suitable for supporting a sketch pad. A water color painting is normally made upon a suitable material supported on a flat substantially horizontal surface. An ordinary easel does not and cannot provide the flat horizontal surface required for many applications.

The portable combination may be used by an architect to draw or paint a conceptual showing or design of a building, for example. However, the architect may additionally find it desirable to make shop drawings of portions of the building. The shop drawings are usually made on a drawing board. The common easel cannot ordinarily be used in place of the drawing or drafting board or as a support for the drawing or drafting board.

For reasons given hereinbefore, there is a need for an improved combination of the easel and the camp chair, where the canvas is supported in a desired position relative to the camp chair and a place is provided to keep the supplies and the like in easy reach. Additionally, the improved combination is positionally adjustable to be useable for making pictorial representations in paint, pastel, pencil, water color charcoal, drafting tools, and any other medium.

SUMMARY OF THE INVENTION

One object of the present invention is to provide a portable combination of an easel and a chair where the easel is in a selectively adjustable desired position relative to the chair.

Another object of the present invention is to provide an easel suitable for use on a relatively flat table or a desk.

Yet another object of the present invention is to provide a portable combination of a chair and an easel adaptable for supporting a drawing or drafting board.

Another object of the present invention is to provide a portable combination of an easel, a chair and a container for art supplies and the like, the container being operably disposed in a location convenient for a user of the combination.

Still another object of the present invention is to provide an easel useable for making pictorial graphic or illustrative representations in any medium.

According to the present invention, a clamp assembly of an easel is adapted for connection to a pair of frame support legs in the general shape of a bellcrank. The connection to the frame support legs is at an operably disposed selectable location thereon. The frame support legs are fixedly connected to the ends of a horizontal bar that carries one end of the seat of a camp chair. The other end of the seat is carried by a horizontal bar connected to a pair of camp chair legs that are connected to respective ones of the frame support legs.

Other objects, features and advantages of the present invention will be more clearly understood from the following detailed description and the accompanying drawings.

BRIEF DESCRIPTION OF THE DRAWINGS

FIG. 1 is a perspective view of the preferred embodiment of the present invention;

FIG. 2 is a side elevation of the embodiment of FIG. 1 adapted for use on a table or a desk;

FIG. 3 is a perspective view of the embodiment of FIG. 1 adapted to support a drawing board;

FIG. 4 is a section of FIG. 1 taken along the line 4—4;

FIG. 5 is a section of FIG. 1 taken along the line 5—5;

FIG. 6 is a perspective view of the embodiment of FIG. 1 adapted for use as a chair and a support and display for a floral arrangement and a painting;

DESCRIPTION OF THE PREFERRED EMBODIMENT

Figure 7:
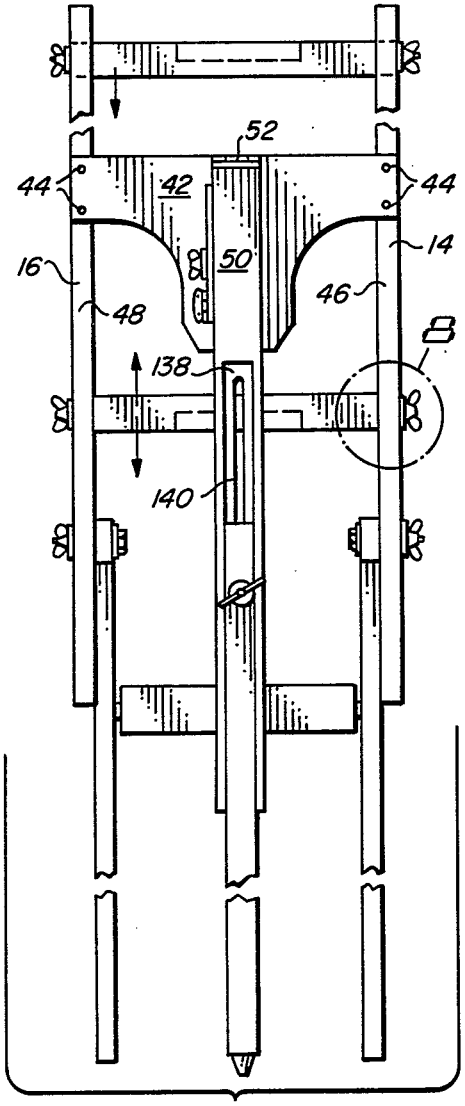
FIG. 7 is a rear elevation of the embodiment of FIG. 1.

As shown in FIG. 1, a convertible easel includes a longitudinally adjustable rectangular clamp assembly 10 wherein a frame-mounted canvas 12 or the like is maintained as explained hereinafter. The assembly 10 has similar elongated vertical frame members or bars 14, 16 with centrally disposed, longitudinal slotted holes or channels 98,100, respectively, therethrough. The bars 14, 16 have substantially rectangular cross-sections and the elongated slots 98, 100 extend substantially the length thereof.

The bar 14 is adjustably connected to a support leg 22 that has the general shape of a bellcrank. The connection of the bar 14 and the leg 22 is provided by a bolt 26 that passes through the slot or channel 98 and a slotted hole 24 in a distal end portion 22D of the leg 22. The lower distal end portion 22P of the leg 22 rests upon the ground. The connection of the bar 14 to the leg 22 is maintained by a wing nut 28 screwed onto the bolt 26.

In a similar manner, the bar 16 is connected to a support leg 30 (similar to the leg 22) by a bolt 32 (similar to the bolt 26) that passes through the slot 100 and a slotted hole 34 in the distal portion 30D of the bellcrank leg 30. The connection of the bar 16 to the leg 30 is maintained by a wing nut 36 (similar to the wing nut 29) that is screwed onto the bolt 32. The lower distal end portion 30P of the leg 30 is adapted to rest securely on the ground or some similar substantially flat surface.

When the wing nuts 28, 36 are loosely screwed onto the bolts 26, 32, the assembly 10 is moveable in translation in directions defined by the slots 24, 34 and the slots 98, 100. When the wing nuts 28, 36 are tightened to clamp at a desired distance from the longitudinal frame bars 14, 16 the legs 22, 30, the assembly 10 to prevent further translation or back and forth movement of the frame with respect to the seat 40.

It should be understood that the bolts 26, 32 are substantially coaxial and the pair of slots 24, 34 are substantially parallel to to one another as are the pair of elongated slots 98, 100. Moreover, the assembly 10 is rotatable about the axis of the bolts 26, 32. As explained hereinafter an elongated support leg of selectively adjustable length restrains the assembly 10 against rotation.

The legs 22, 30 have a horizontal bar 38 connected therebetween in any suitable manner. The bar 38 provides lateral support to the legs 22, 30, whereby the legs 22, 30 are maintained in a substantially parallel relationship. Additionally, the bar 38 is operably connected to a foldable fabric seat 40 at an end portion 41D thereof by any conventional fastening means. Therefore an artist may straddle the seat 40 and be seated thereon while painting upon the canvas 12. The seat 40 is additionally supported at an end portion 41P thereof as explained hereinafter.

Since the assembly 10 is moveable in translation in the directions defined by the slots 24, 34, the assembly 10 is moveable towards and away from the seated artist. Hence, the canvas 12 may be positioned at any desired distance from the seated artist. Since the assembly 10 is moveable in translation in the directions defined by the slots 98, 100, the assembly 10 is moveable in a generally upward and downward direction relative to the seated artist.

As best shown in FIG. 7, the bars 14, 16 are symmetrically connected to a lateral support member 42 by screws 44. The member 42 is a flat, generally T shaped panel. However, the member 42 may alternatively be a rectangular panel.

The screws 44 pass through the member 42 and through rear surfaces 46, 48 of the bars 14, 16 respectively, whereby, the member 42 abuts the rear surfaces 46, 48 of elongated bars 14, 16, respectively. It should be understood that the drawing board, drafting board, paper, sketch pads or canvas 12 or the like is in a proximal relationship to the front surfaces 46A, 48A, of the bars 14, 16 (FIG. 1). The member 42 maintains the bars 14, 16 in a parallel relationship.

Figure 11:
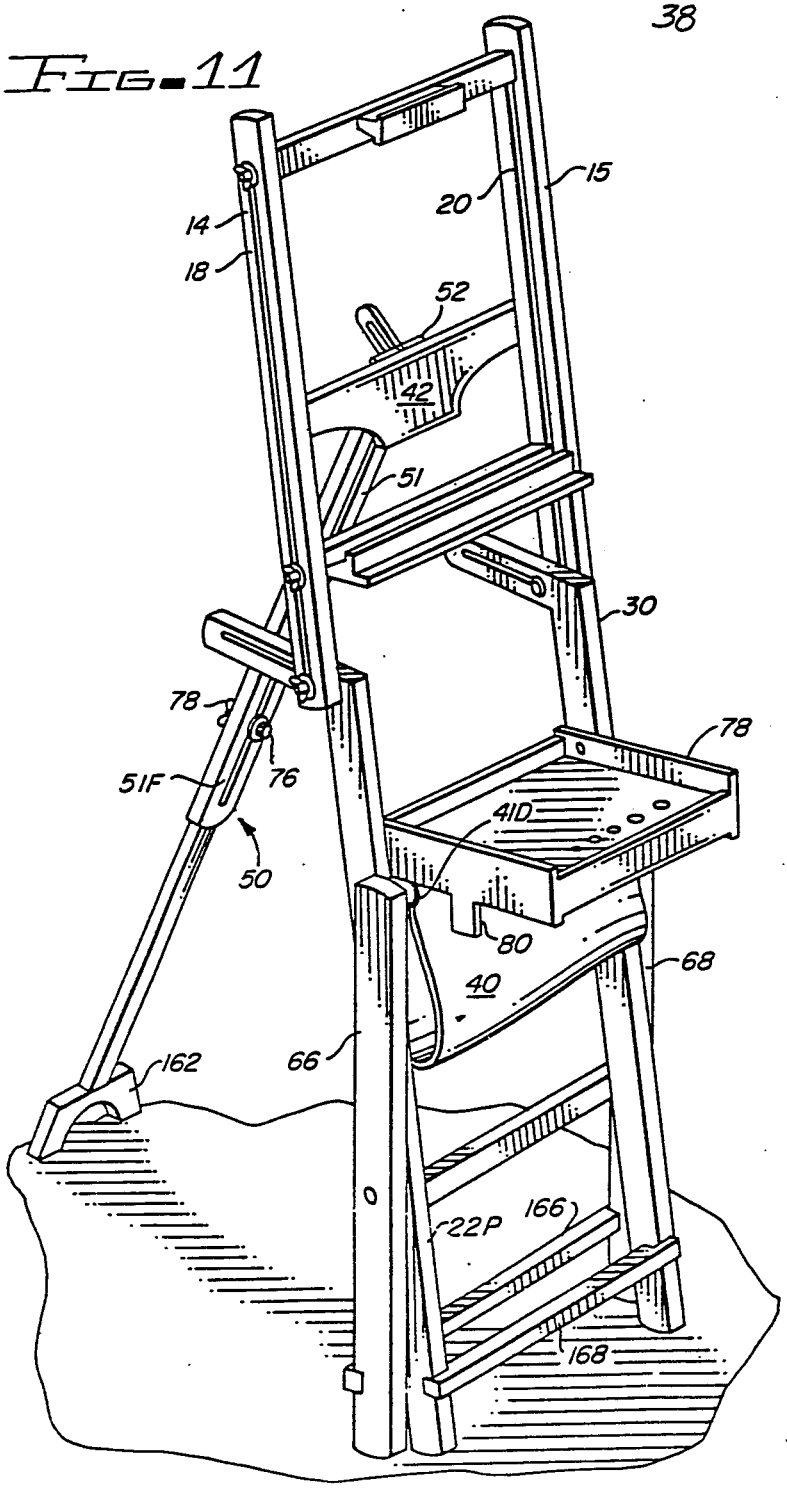
FIG. 11 is a perspective view of the embodiment of FIG. 1 with a folded camp chair.
Figure 12:
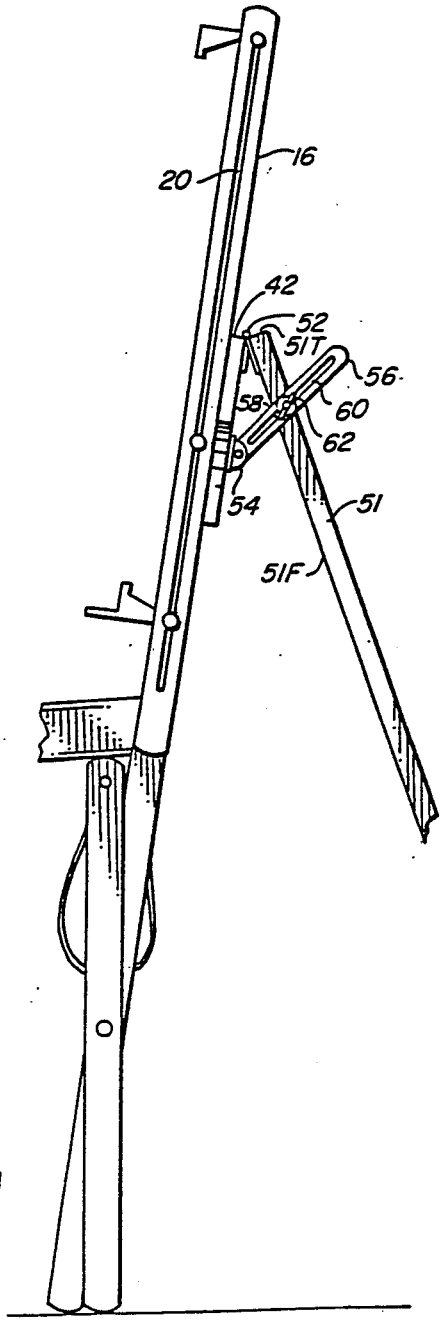
FIG. 12 is a side elevation of the embodiment of FIG. 1 as shown in FIG. 11.

As shown in FIGS. 7, and 11–14, a an elongated leg of adjustable length 50 has an upper portion 51 with a generally channel-shaped cross-section. The elongated leg portion 51 is including the channel 51C connected near its top end portion 51T at a front surface 51F to the support 42 by a conventional hinge assembly 52 (FIG. 12). The hinge 52 is equidistant from the legs 14, 16, whereby the leg 50 is symmetrically disposed relative to the bars 14, 16 generally parallel thereto (FIG. 7). The lower elongated support leg portion 51L is generally rectangular and is adapted to slidably engage the channel 51C to become substantially coaxial therewith and for longitudinal motion therein as hereinafter described.

As shown in FIG. 12, the support 42 is additionally connected to a pivot 54 whereon a slotted bar 56 pivots in a plane substantially perpendicular to the longitudinal axis of the support 42 (FIG. 12.) The pivot 54 is positioned below the hinge 52 and closer to the bar 16 than to the bar 14, whereby the bar 56 abuts the inside surface or leg portion 51.

A bolt 58 passes from the leg portion 51 through a slot 60 in the bar 56. A wing nut 62 on the bolt 58 fastens the bar 56 to the upper leg portion 51. When the wing nut 62 is loosely screwed onto the bolt 58, the leg 50 is rotatable about the hinge 52. When the wing nut 62 is tightened the leg 50 is secured, restrained or maintained against rotation. Accordingly, the leg 50 may be selectively maintained in a desired angular relationship to the assembly 10.

It should be understood that when the leg 50 is maintained against rotation and a lower portion of the leg 50 (described hereinafter) rests upon the ground, the assembly 10 is maintained against rotation about the axis of the bolts 26, 32. Therefore, by selecting the angular relationship of the leg 50 to the assembly 10 and by adjusting the length of the upper leg 50, the canvas 10 is at a desired angle to a horizontal datum plane.

The structure of the seat 40 includes a horizontal bar 64 (similar to the bar 38) operatively disposed between the upper distal end portions of chair legs 66, 68 for supporting the legs and seat 40 and maintaining the legs substantially parallel, the opposite end of the chair seat being operatively connected to the horizontal bar 64 at 41P. The ends of the bar 64 are respectively connected to camp chair legs 66, 68 near the upper ends thereof. The lower ends of the legs 66, 68 are adapted to rest upon the ground to support the chair and at least partially the easel assembly.

As shown in FIGS. 1 and 2, bolt 70A passes through holes in the legs 22, 66 into one end of a horizontal support bar 72. The hole in the leg 66 is generally near its midpoint. A bolt, 70B (FIG. 6) similar to the bolt 70A, passes through holes in the legs 30, 68 into the other end of the bar 72. Like the leg 66, the hole through the leg 68 is generally near its midpoint. It should be understood that there is a coaxial relationship between the bolts 70A, 70B and the camp chair legs 66, 68 are rotatable about the axis of the bolts 70A, 70B.

Preferably, a camp chair brace 74, connects the legs 22, 66. The brace 74 is comprised of two similar members that are pivotably connected near the middle of the brace 74. However, when the seat 40 is unfolded, an over the center lock 74C of the brace 74 causes the brace 74 to be rigid. A brace 76, similar to the brace 74 connects the legs 22, 66. The braces 74, 76 are of a type well known in the art.

Figure 9:
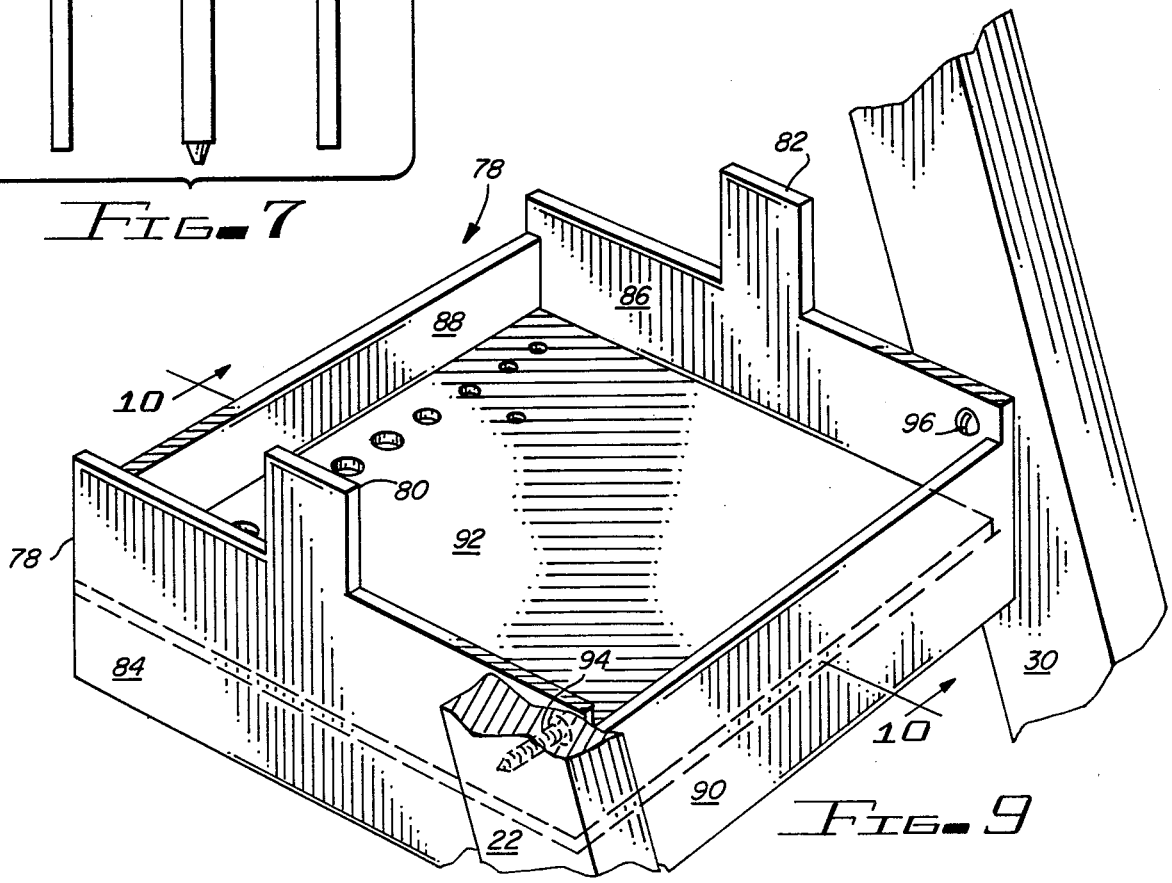
FIG. 9 is a perspective view of the tray in the embodiment of FIG. 1.
Figure 10:
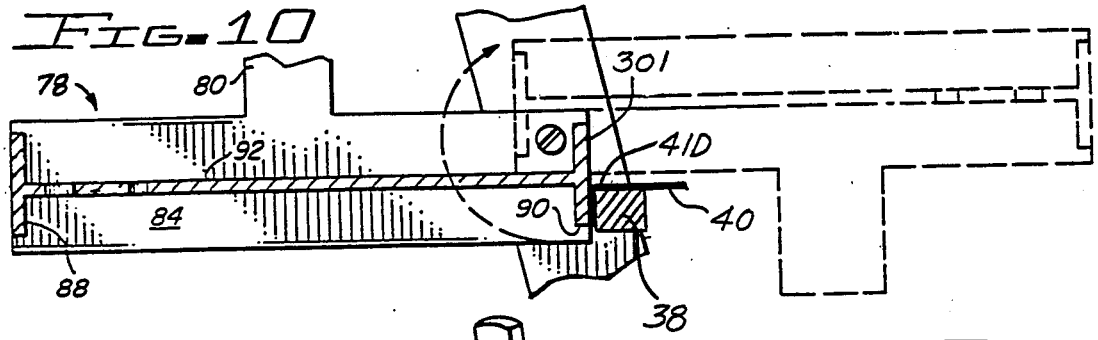
FIG. 10 is a section of FIG. 9 taken along the line 10—10.

As shown in FIGS. 9–11, when the legs 66, 68 are rotated to fold the seat 40 (FIG. 11) the lower leg portion 22P and the proximal portion of the leg 30 are nearly parallel to the legs 66, 68. Additionally, a plastic tray 78 is operatively disposed proximate seat end 41D. The tray 78 is a single integral with stops 80, 82 that prevent the end 41D from moving to cause the seat 40 to unfold.

The tray 78 is substantially a rectangular frame that includes generally rectangular sides 84, 86 connected to a generally rectangular front panel 88 and a generally rectangular rear panel 90 (FIG. 9). The sides 84, 86, and the panels 88, 90 are all connected to a rectangular tray panel or surface 92 operably disposed so as to be approximately centered within the frame 84, 86, 88, 90. The tray 78 is adapted to hold artist's supplies, draftman's supplies, drawing equipment, and the like. In this embodiment, the panels 88, 90 are narrower than the sides 84, 86.

The sides 84, 86 are connected near corresponding corners thereof to the legs 22, 30, respectively by similar screws 94, 96. Moreover, the screws 94, 96 are coaxial. The tray 78 is rotatable about the axis of the screws 94, 96.

Accordingly, when the seat 40 is folded, the tray 78 is rotated to a portion shown in broken lines in FIG. 10, the tray 78 is in a position for the panel 92 to be a supporting surface for the brushes and paints of an artist who paints while standing.

As best shown in FIGS. 1 and 10, when the seat 40 is unfolded, the tray 78 is rotated to cause the stops 80, 82 to extend upward (shown in solid lines in FIG. 10). Moreover, the panel 90 abuts the seat end 41D; the tray 78 is in a position for the panel 92 to be a supporting surface for the brushes and the paints of the seated artist or the like.

Figure 8:
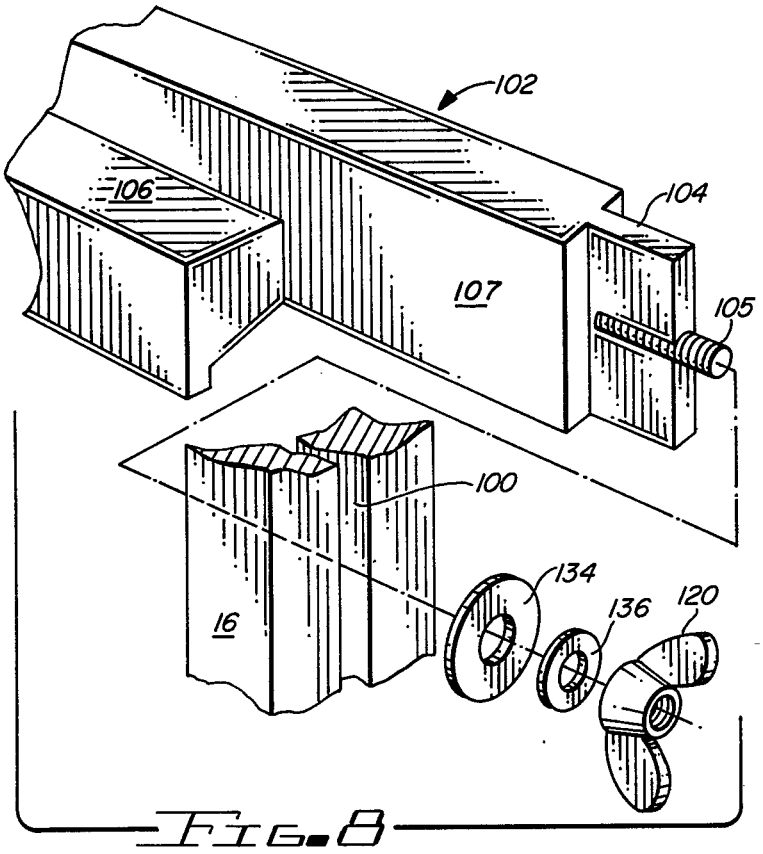
FIG. 8 is a fragmented exploded view, with parts broken away, of a portion of the preferred embodiment shown within the dashed line circle of FIG. 7.

As shown in FIGS. 1 and 8, the assembly 10 includes a horizontal bar 102 with a generally rectangular cross-section. The bar 102 has a tongue 104 at each end. A bolt 105 protrudes from the ends of each of the tongues 104. The tongues 104 are adapted to fit within the slots 98, 100 referred to hereinbefore. Midway between the tongues 104, an upper clamp member 106 is connected to the bar 102 on a front face 107 thereof.

As shown in FIG. 4, the upper clamp 106 is a bar with parallel sides 108, 110 and non parallel sides 112, 114. Additionally, a lip 116 extends from the side 114. The side 114 is contiguous with a lower edge 118 of the bar 102 and slopes to one edge of the lip 116. The other edge of the lip 116 is contiguous with the side 110 and the end of the lip 116 between the edges is substantially parallel to the top edge 112. The side 114 and the lip 116 form a hook with the lip 116 overhanging the top edge of the canvas 12.

When the tongues 104 are fitted within the slots 98, 100, the bolts 105 extend therefrom, (FIGS. 1 and 8), wing nuts 120 are screwed onto the bolts 105.

When the wing nuts 120 are loosely screwed onto the bolts 105, the bar 102, and hence the clamp member 106, is moveable in translation in directions defined by the slots 98, 100 or up and down the clamping frame 10. When the wing nuts 120 are tightly screwed onto the bolts 105, the bar 102 is locked, secured or maintained against translation. Accordingly, the bar 102 is moveable to cause the lip 116 to overhang and operatively engage the canvas 12 for clamping or positioning purposes.

As shown in FIGS. 1 and 5, the assembly 10 additionally includes a lower clamp 122 of substantially the same length as the bar 102. Moreover, the clamp 122 includes bar member 119 is substantially parallel to bars 14, 16 which include tongues 124 and bolts 125 at both ends (FIG. 5). The tongues 124 and the bolts 125 are respectively similar to the tongues 104 and bolts 105 described hereinbefore. The clamp 122 has a cross section wherein a longitudinal channel 126 is defined. Additionally, a lip 128 extends from the clamp 122 outside of the channel 126.

When the tongues 124 are fitted within the slots 98, 100, the bolts 125 extends therefrom. Wing nuts 132 (FIG. 1) are screwed onto the bolts 125.

When the wing nuts 132 are loosely screwed onto the bolts 125, the clamp 122 is moveable in translation in the directions defined by the slots 98, 100. When the wing nuts 132 are tightly screwed onto the bolts 125, the clamp 122 is secured or maintained against translation longitudinal or vertical movement. Therefore, the bar 102 and the clamp 122 generally define a generally rectangular frame of longitudinally adjustable length.

The midportion of the bottom edge of the canvas 12 or the like fits within the channel 126 which is selectively positioned up or down in the elongated slots 98, 100, as desired. Accordingly, the clamps 106, 122 maintain the canvas in the assembly 10. The clamps 106, 122 being selectively positioned up and down the longitudinal axis of the frame within the elongated slots 98, 100 to select the desired position for the surface upon which the artist or the like is to work. The lip 128 is utilized in a manner described hereinafter.

Preferably, washers 134, 136 (FIG. 8) are disposed on the bolts 105 between the wing nuts 120 and the bar 16. Similarly washers may be similarly used with all other wing nuts referred to herein.

Figure 13:
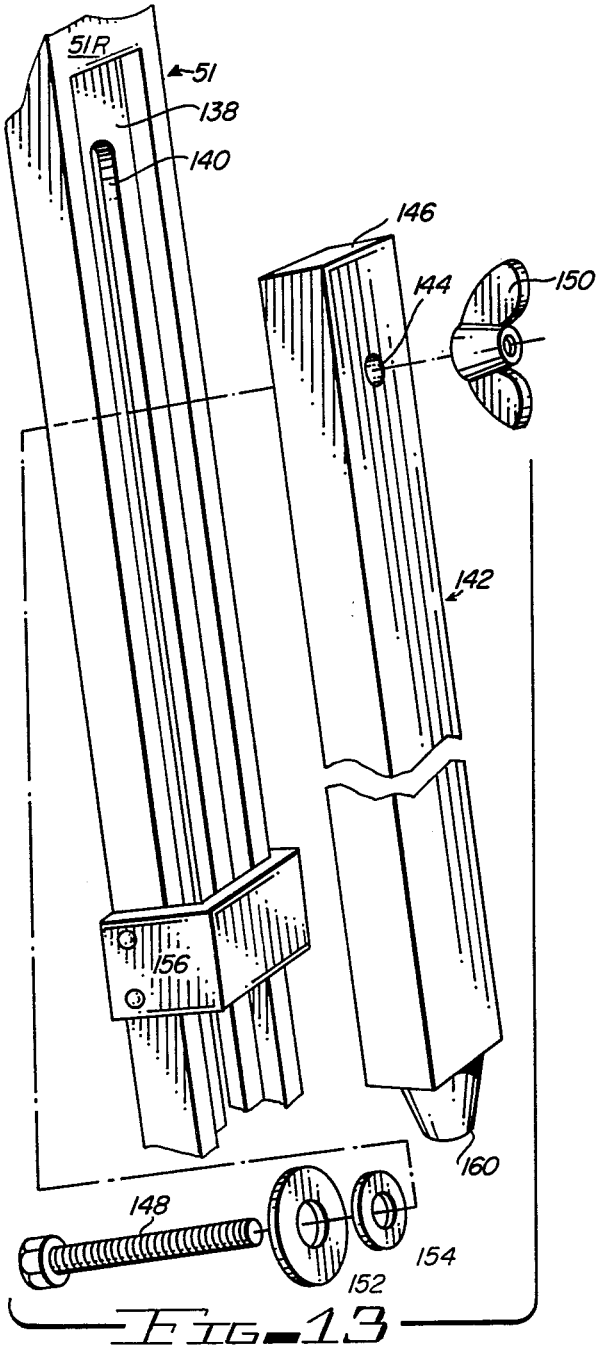
FIG. 13 is a perspective view partially exploded with parts broken away of an adjustable leg in the embodiment of FIG. 1.
Figure 14:
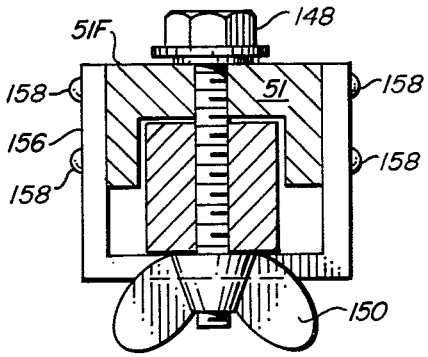
FIG. 14 is a cross-sectional view of the adjustable leg in the preferred embodiments shown in FIG. 2 taken along the line 14—14.

As shown in FIGS. 13 and 14, the leg portion 51 further includes a recess channel 138 in a rear surface 51R of the upper leg portion 51. The recess 138 causes the leg portion 51 to have the channel-shaped cross-section as stated hereinbefore.

The recess 138 extends through approximately the lower 80 percent of the upper leg portion 51. In an alternative embodiment, a similar recess may extend over a greater or lesser percentage of the leg portion 51.

Centrally located within the recess 138 is an elongated slotted hole 140 that extends substantially the entire longitudinal length of the recess 138. As explained hereinafter, the recess 140 and the slot 138 are used for providing selectively adjustable length for the leg 50.

The leg 50 additionally includes a lower portion 142 that has a generally rectangular cross-section. Additionally, a hole 144 passes through the lower leg portion 142 near its top end portion 146.

The leg portion 142 is slidably placed or inserted within the recess channel 138. Additionally, the leg portions 51, 142 are connected together by a bolt 148 that passes through the slot 140 and the hole 144. A wing nut 150 screws onto the bolt 76.

Because of the slot 140, when the wing nut 150 is loosely screwed onto the bolt 148, the leg lower portion 142 is slidably positionable within the recess 138 for selectively adjusting the height of the clamping frame 10. When the wing nut 150 is tightly screwed onto the bolt 148, the leg portion 142 is locked, restrained or maintained against sliding in either direction. It should be understood that the length of the leg 50 is adjusted by the sliding of the leg portion 142 into and out of the recess channel 178. Preferably, washers 152, 154 are disposed on the bolt 148 between its head and the surface 51F.

Preferably, a U-shaped bracket 156 is connected by screws 158 to the upper leg portion 51 approximately midway between its ends. The bracket 156 maintains or securely restrains the leg lower portion 142 within the recess 138.

In this embodiment, the bottom of the leg portion 142 is a boss 160. Although the boss 160 is suitable for resting upon the ground, preferably, a decorative footing 162 fits thereon (FIG. 1).

As shown in FIG. 2, when the legs 22, 30 are not connected to the assembly 10, the leg 50 and the bars 14, 16 form a tripod. The tripod is suitable for placement on a desk or on a table whereby the convertible easel forms a table easel.

As shown in FIG. 3, when the length of the leg 50 is suitably adjusted and the leg 50 is suitably rotated, the assembly 10 may be used to support a drawing board 164 where an edge thereof is retainably disposed within the lower clamping channel 126. Alternatively, the drawing board, or a watercolor sketch pad or the like may be placed upon the lip 128 without clamping action. It should be appreciated that the convertible easel is easily adjusted, as explained hereinbefore, to cause the drawing board or the sketch pad to be positioned to provide a substantially horizontal or slightly tilted surface.

As shown in FIG. 6, the tray 78 and assembly 10 may be used for supporting a flower arrangement or the like and a painting, respectively. Hence, the convertible easel may be used as a decorative furnishing or a conversation piece or the like.

Figure 15:
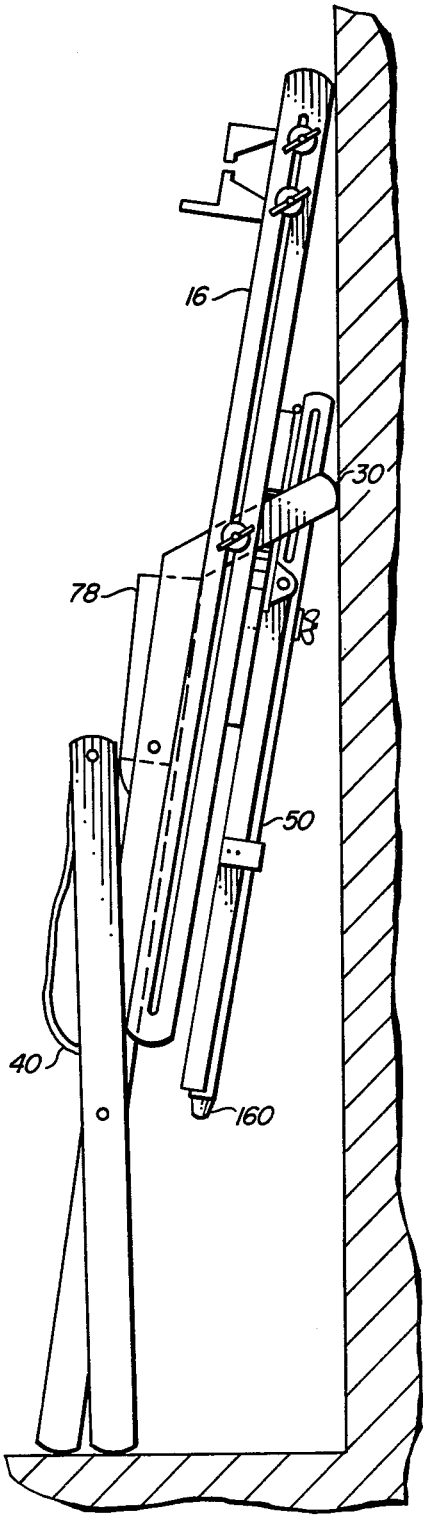
FIG. 15 is a side elevation of the embodiment of FIG. 1 where the elements are collapseably arranged for portability.

As shown in FIG. 15, the seat 40 is folded and the leg 50 is shortened by suitable sliding the leg portion 142. Additionally, the tray 78 is folded to extend between the legs 22, 30. The convertible easel is thereby reduced or collapsed to a size that makes it easily portable.

As shown in FIG. 11, a horizontal bar 166 is connected to the legs 66, 68 within notches therein. Similarly, a horizontal bar 168 is connected to the legs 22, 30 within notches therein. The bars 166, 168 provide lateral structural support for the chair and frame.

While the invention has been particularly shown and described with reference to a preferred embodiment thereof, it should be understood by those skilled in the art that various modifications and alterations can be made in the structure and materials described herein without departing from the spirit and scope of the invention which is limited only be the appended claims.

What is claimed is:

1. A convertible easel having a clamp assembly that generally defines a rectangular frame of adjustable length whereon a work piece may be positionably retained, comprising:

a first frame support leg in the general shape of an L-shaped bellcrank having a first relatively straight elongated leg portion and a first generally horizontal leg extension, said leg extension including an elongated slot therein, said slot extending substantially the entire length of said extension leg, for defining a multiplicity of positionable locations along said elongated leg slot for operably coupling said first frame support leg to said clamp assembly through said elongated slot extension;

a second frame support leg, in the general shape of an L-shaped bellcrank having a second relatively straight elongated leg portion and a second generally horizontal leg extension, said leg extension including an elongated slot extending substantially the entire length thereof, said slot for defining a multiplicity of positionable locations along said leg extension for connection to said clamp assembly, the proximal end portions of said first and second frame support legs being adapted for resting on the ground without slipping and the like;

a first camp chair leg rotatably connected near its mid point to the corresponding distal end portion of said first frame support leg;

a second camp chair leg rotatably connected near its mid point to the corresponding portion of said second frame support leg; and a foldable seat having first and second ends connected to said first and second camp chair legs and to said frame support legs, respectively.

2. The convertible easel of claim 1 wherein said elongated slots of said first and second generally horizontal leg extension includes fastening means for selectively positioning the rectangular frame toward and away from the camp chair along the length of said elongated slot and for enabling the frame to be tilted with respect to vertical and manually selected in any given tilt position, the connection of said generally horizontal leg extension and said L-shaped bellcrank frame support legs being made by manually-adjustable-fastening means that passes through said clamp assembly and said said elongated slot.

3. The convertible easel of claim 2 wherein said clamp assembly includes first and second frame sides each of which includes a pair of generally parallel, spaced apart vertical bars each including an elongated vertical slot therethrough and fastening means passing through said elongated vertical slots.

4. The convertible easel of claim 1 wherein said clamp assembly includes a pair of substantially parallel, spaced apart vertical bars, additionally comprising a lateral support means fixedly secured proximate to mid portion of said pair of vertical bars and on the rear surface thereof opposite said chair, further comprising a rear support leg of adjustable length hingedly connected to a central portion of said lateral support for stabilizing the convertible easel, said vertical bars and said rear support leg of adjustable length forming a tripod-type of configuration for-stabilizing the easel; and means for maintaing a desired angular relationship between said clamp assembly and said rear support leg of adjustable length.

5. The convertible easel of claim 1 additionally comprising a tray having the sides that define a generally rectangular tray frame wherein a rectangular panel is connected substantially midway within said frame, to opposed sides of said tray being respectively connected to the first relatively straight elongated leg portion of said frame support legs.

6. The convertible easel of claim 5 wherein the opposite ends of a first horizontal bar are respectively connected to said first and second frame support legs and a second horizontal bar is connected to said camp chair legs, said tray including a first tray portion having a pair of stop members extending generally perpendicular thereto for preventing the chair legs from unfolding when the easel is used in the standing position, said tray being rotatable in one direction to cause the edges thereof to rest upon said second horizontal bar when the easel is used in the standing position, said tray being rotatable in the opposite direction to cause one of the sides perpendicular to said opposed sides to abutt said first horizontal bar.

7. The convertible easel of claim 5 wherein said panel has a plurality of brush-receiving apertures therethrough.

8. The convertible easel of claim 1 additionally comprising means for operably coupling a drawing board to said clamp assembly.

9. The convertible easel of claim 1 wherein said clamp assembly comprises:

a pair of substantially parallel spaced apart vertical members each having a generally vertical elongated slot therethrough which extends substantially the entire length thereof; an upper horizontal member operably slidably coupled to said pair of vertical members through said elongated vertical slots, said upper horizontal bar being movable in translation in directions defined by said slots;

fastening means operatively coupled through the elongated vertical slots of said pair of vertical members for selectively positioning said upper and lower horizontal bars with respect to one another for varying the size of the frame-mounted canvas which can be retained therein and the height of the canvas with respect to the ground; an upper clamping means operably coupled to said horizontal bar in the general shape of a hook, said hook being adapted to overhang an edge of a frame-mounted for clampably engaging said frame mounted canvas and the like; and a lower clamping means operatively coupled to-said pair of vertical members through said elongated vertical slots, said lower clamping means having a channel shaped cross-section for operatively engaging the lower end of a frame mounted-canvas and the like, said lower clamping means being movable in translation in said directions defined by said slots and operably secured at a selected location by said fastening means.

10. The convertible easel of claim 9 wherein said lower clamping means includes a lip proportion extending outwardly from said lower clamp for operatively engaging the bottom edge of a frame mounted canvas and the like for clampably engaging the same.

11. A portable chair and easel-like apparatus comprising:

a generally rectangular frame means for operatively positioning and retaining a work surface;

a chair means including a forwardly extending, elongated, L-shaped leg member having a first relatively straight slanted leg portion and a second generally horizontal leg extension, said leg extension including an elongated generally horizontal slot extending substantially the entire length thereof, said chair means being opperatively coupled to said frame means for enabling an artist or the like to sit down while engaging in artistic pursuits upon said work surface;

fastening means for operatively engaging said elongated slot in said L-shaped leg member and the lower end portion of said frame for selectively moving said generally rectangular frame means toward and away from said chair means; and an elongated, positionally adjustable support means operatively coupled to said elongated slots of said leg means and responsive to said fastening means for mounting said frame means in a selected position with respect to said chair means and for selectively controlling the tilt of said frame means with respect to vertical.

12. The apparatus of claim 1 wherein said generally rectangular frame means includes first and second substantially parallel, one piece longitudinal frame members, and an elongated slot means proximate the middle of said frame members and extending substantially the entire length of said frame members;

upper work surface-engaging means including a horizontal bar operatively coupled between said frame members proximate the top portions thereof and generally perpendicular to said frame members for supporting same, said work surface-engaging means including a work surface engaging member operatively secured to the mid portion of said horizontal bar and selectively positionable means operably disposed proximate the distal ends of said bar and extending through said elongated slots and means proximate the opposite surface of said longitudinal frame members for operatively releasing said bar for selectively positioning said horizontal bar and said work surface engaging means longitudinally up and down parallel to the axis of said frame means and within said slots and for operatively retaining said bar at a selected location for positioning the work surface by said work surface-engaging means.

13. The apparatus of claim 12 wherein said support means further includes support leg means;

a panel operatively secured to the rear surface of said frame members proximate the middle portion thereof;

a top support leg portion;

a bottom support leg portion;

hinge means operatively disposed for coupling the distal end of said top support leg portion to the mid portion of said panel;

pivot means for operatively enabling said support leg means to move toward and away from said chair means;

slotted arm means having one end pivotally attached to said pivot means;

fastening means operatively disposed through said slot and said arm means and into the side of the upper end portion of said top support leg portion for enabling said support leg to be operatively secured at any given position therebetween;

said top support leg portion including a generally U-shaped channel extending substantially the entire length thereof and in an elongated slot proximate to middle channel and extending substantially the longitudinal length thereof;

said botton support leg including a generally rectangular leg member dimensioned to operatively slide within said elongated channel for selectively varying the length of said support leg means by manually, operatively adjusting fastening means extending through said slot, said channel, and said bottom support leg portion; and foot means including a substantially horizontal member-approximatly perpendicular to the longitudinal axis of said support leg and extending outwardly therefrom, said foot means operatively coupled to the lower distal end of said bottom support leg portion for operatively disposing said support leg portion on the floor, the ground and the like to prevent slipping, tilting and instability.

14. A combination chair and easel assembly comprising:

a first pair of generally rectangular, substantially parallel chair legs;

a second pair of generally rectangular, substantially parallel, L-shaped elongated legs, said elongated legs having a length substantially greater then the length of said first pair of chair legs;

a first support means operatively coupled proximate the top distal end portion of said first pair of chair legs and disposed substantially perpendicular thereto for forming a first chair support;

a second support member operatively disposed between a corresponding portion of said elongated L-shaped leg members for supporting same and providing a second chair support;

seat means operatively coupled between said first and second chair supports for forming a seat;

a common support member operatively coupled between the mid portion of both said first pair of chair legs and said elongated pair of chair legs to pivotally attach said first and second pair of chair legs to enable the chair to open and close as desired;

a pair of elongated longitudinal frame members having slot portions aligned with the axis thereof and extending substantially the entire length thereof;

said L-shaped legs having the short portion thereof provided with a generally horizontal slot and fastening means is provided for passing through both the slot of the elongated longitudinal frame member and the slotted portion of the L-shaped leg member for selectively securing the elongated frame members against translational movement and for selectively positioning the elongated frame members in translation as desired;

a first clamping member including clamping means thereon and having its opposite end portions secured by fastening means extending through the slot in the upper end of said elongated frame members and being loosened to allow downward positioning of said clamping member and tightened to lock the clamping member in a desired position;

said clamping means including a curved surface and a lip portion for operatively engaging any size canvas, drafting board, or other work media and positionably retaining same during work thereon;

a lower clamping member and means for operatively securing said clamping member within the lower portion of the elongated slot of said longitudinal frame members so as to enable selective vertical positioning and walking against movement once the correct working position has been established;

a support member operatively coupled between the rear portion of said longitudinal frame members and generally perpendicular thereto, a two-piece telescopically adjustable leg means including locking means for selectively adjusting the length of said leg means and locking same at a desired position, positioning means operably disposed on the back of said support member for enabling said leg means to be pivoted thereabout so as to be folded toward and away from said leg portions and locked in a desired position by fastening means associated therewith.

15. The assembly of claim 14 further including a flip tray means pivotally secured at one end thereof to opposite sides of said L-shaped leg means proximate said second support, said tray means being operable to flip over to the opposite side of said L-shaped leg members when the assembly is used in the sitting position so as to be operably disposed out of the seated persons way and able to hold supplies and the like.

16. The apparatus of claim 14 wherein said frame member, and top of said L-shaped leg members, the central portion of said elongated support leg, a means on the back of said support extending across the mid ortion of said longitudinal frame members include slot means and each include a locking means for selectively enabling relative movement between various members as said locking means are selectively loosened and tightened so that the apparatus of the present invention can be positioned into a multiple number of positions for a multiple number of uses by artist and the like.

* * * * *